US007363962B2

(12) United States Patent
Cleland

(10) Patent No.: US 7,363,962 B2
(45) Date of Patent: Apr. 29, 2008

(54) COLD PLATE FOR BEER DISPENSING TOWER

(75) Inventor: James M. Cleland, Cyress, CA (US)

(73) Assignee: Cleland Sales Corporation, Los Alamitos, CA (US)

( * ) Notice: Subject to any disclaimer, the term of this patent is extended or adjusted under 35 U.S.C. 154(b) by 413 days.

(21) Appl. No.: 10/633,728

(22) Filed: Aug. 4, 2003

(65) Prior Publication Data

US 2005/0028964 A1 Feb. 10, 2005

(51) Int. Cl.
*B67D 5/62* (2006.01)
*F28F 3/12* (2006.01)
*F25D 3/02* (2006.01)

(52) U.S. Cl. ..... 165/47; 165/101; 165/157; 165/168; 165/164; 62/398; 62/399; 62/400; 62/389; 222/129.1; 222/146.6

(58) Field of Classification Search ..... 165/47, 165/168, 169, 164, 157, 101; 62/396, 390, 62/389, 399, 398, 400; 222/146.6, 129.1
See application file for complete search history.

(56) References Cited

U.S. PATENT DOCUMENTS

| | | | | |
|---|---|---|---|---|
| 699,319 | A | | 5/1902 | Henning |
| 1,702,565 | A | | 2/1929 | Foster |
| 1,799,991 | A | | 4/1931 | Sellick et al. |
| 1,899,629 | A | | 2/1933 | Morse |
| 1,965,553 | A | | 7/1934 | Lear |
| 1,969,643 | A | | 8/1934 | Fuchs et al. |
| 2,009,883 | A | | 7/1935 | Frank |
| 2,188,506 | A | * | 1/1940 | Hall ..... 426/471 |
| 2,267,819 | A | | 12/1941 | Di Pietro |
| 2,653,014 | A | | 9/1953 | Sniader |
| 2,663,551 | A | | 12/1953 | Boling |
| 2,766,019 | A | | 10/1956 | Adams et al. |
| 2,771,752 | A | | 11/1956 | Tennant |
| 2,828,948 | A | | 4/1958 | Caldwell, Jr. et al. |
| 3,011,323 | A | | 12/1961 | Jacges |
| 3,229,762 | A | | 1/1966 | Vollhardt |
| 3,331,536 | A | | 7/1967 | DeLorenzo |
| 3,469,415 | A | | 9/1969 | Cornelius |
| 4,285,385 | A | | 8/1981 | Hayashi et al. |
| 4,291,546 | A | | 9/1981 | Rodth |
| 4,617,807 | A | | 10/1986 | Pritchett et al. |

(Continued)

FOREIGN PATENT DOCUMENTS

WO WO 9710171 A1 * 3/1997

*Primary Examiner*—John K. Ford
(74) *Attorney, Agent, or Firm*—Fulwider Patton LLP

(57) ABSTRACT

A cold plate for a beverage chilling apparatus comprising a plurality of beverage conducting tubes sinuously arranged within a cast aluminum jacket. Interleaved between the beer conducting tubes are coolant conducting lines arranged in heat exchanging relation. The coolant lines are derived from a main coolant line pumping coolant to the cold plate, where a coolant inlet is divided into two separate smaller intermediate coolant segments at a first stage. Each intermediate glycol segment is then subdivided at a second stage into four heat exchanging coolant lines. At each subdivision of the coolant fluid conducting system, a pair of smaller lines equal distance from a feed line and having a smaller diameter than the feed line are incorporated using a two-for-one splitter so that each stage doubles the number of lines from the previous stage.

8 Claims, 4 Drawing Sheets

U.S. PATENT DOCUMENTS

| | | | |
|---|---|---|---|
| 4,678,104 | A | 7/1987 | Pritchett |
| 4,730,463 | A | 3/1988 | Stanfill |
| 4,781,309 | A | 11/1988 | Vogel |
| 4,888,961 | A | 12/1989 | McMichael |
| 5,226,296 | A | 7/1993 | Kolvites et al. |
| 5,249,710 | A | 10/1993 | Hassell et al. |
| 5,339,892 | A | 8/1994 | Clifton |
| 5,343,716 | A | 9/1994 | Swanson et al. |
| RE34,834 | E | 1/1995 | Swanson |
| 5,484,015 | A | 1/1996 | Kyees |
| 5,524,452 | A | 6/1996 | Hassell et al. |
| 5,564,602 | A | 10/1996 | Cleland et al. |
| 5,694,787 | A | 12/1997 | Cleleand et al. |
| 5,996,842 | A | 12/1999 | Riley et al. |
| 6,098,418 | A | 8/2000 | Kyees |

* cited by examiner

COLD PLATE FOR BEER DISPENSING TOWER

BACKGROUND OF THE INVENTION

1. Field of the Invention

The present invention is related generally to beverage dispensing systems employing a cooling subsystem, and more particularly to a chilling glycol circulation system incorporated in a cold plate for a beverage dispensing system.

2. Description of Related Art

In a large number of restaurants, taverns, pubs, and clubs where beer is sold at a bar, beer kegs are stored in a cold room where they can be maintained at a reduced temperature along with other perishable food items and beverages. These cold rooms are typically maintained at a temperature of approximately 40° F. The beer is conducted from the cold rooms to serving towers at the bar through plastic tubes or beer lines that extend within a thermally insulated jacket, or trunk line. The distance between the cold room and the tower can be as little as fifteen feet and as great as two hundred feet, depending on the layout of the particular establishment. To move the beer through the lines, such systems require a pressurization subsystem that forces the beer from the cold room down the length of beer line to the beer tower for dispensing. The pressurization subsystem introduces a gas such as nitrogen or carbon dioxide into the beverage, pressurizing the beverage to enable it to be pumped through the beer lines.

As the beer is communicated from the cold room to the dispensing tower, it gains heat from the ambient atmosphere and warms to a temperature above the original 40° F. Even enveloped in the thermally insulated trunk line, traveling seventy five feet the beer in the trunk line can result in a beer temperature increase of 8° F. at the end of the trunk line. Thus, where the length of the beer lines from the cold room to the dispensing towers is not minimal, the beer dispensing system will traditionally include one or more refrigerated glycol chillers that incorporate glycol re-circulating lines of plastic tubing that extend within the thermally insulated trunk line carrying the beer lines. The presence of the glycol recirculation lines can reduce the warming of the beer by five to six degrees, resulting in an end temperature as low as 42° F., or a two degree rise from cold room to the end of the trunk line.

The trunk lines may lead to a counter top supporting cabinetry such that their downstream ends terminate below the counter tops, where they connect with balance lines that extend from the down stream end of the trunk line to the delivery tubes adjacent the respective dispensing valve. In practice the beer flowing from the beer lines, through the balance lines and stainless steel tubes can be expected to further warm from 2° F. to 4° F. Accordingly, in the example above beer initially at 40° F. in the cold room is warmed to 42° F. at the downstream end of the trunk line, and further warmed to approximately 45° F. by the time it reaches the dispensing valve.

When beer is charged with a gas such as carbon dioxide to move the beer through the various lines, the gas is entrained in the fluid and resides in a stable state for temperatures below or at approximately 30° F. That is, the gas does not bubble out of the fluid but is carried by the fluid and gives the beverage its distinctive effervescence when consumed. However, as the temperature of the beer rises above 30° F., the gas gradually becomes increasingly unstable and begins to bubble or foam out of the flowing beer. Further warming of the beer increases the foaming effect as the gas bubbles coalesce and propagate downstream, and foaming is further exacerbated by disturbances in the beer such as the turbulence generated when the beer is dispensed from the dispensing valve. When beer is warmed to 45° F. or more, the gas becomes so unstable and so much foam is generated when it is dispensed through the valves that it can often times cannot be served to patrons. As a result, the beer dispensed through the valve must be discarded as waste resulting in significant erosion of the owner's profit.

In the recent past, the purveyors of beer using systems such as that described above have resorted to the inclusion of jacketed heat exchangers in the beer distribution systems just prior to the dispensing valves to chill beer to a low temperature at the down stream end of the trunk lines. The heat exchangers are thermally insulated cast aluminum or aluminum alloy cold plates that incorporate stainless steel tubular beer conducting coils for communicating beer from the downstream end of the trunk lines to the upstream end of the balance lines. Within the cold plates next to the beer conducting coils are a series of coolant re-circulating coils used to remove heat from the beer in a heat exchanger relationship. Typically the coolant used in such systems has been glycol.

The chilled glycol carries heat away from the cold plate and the beer lines within the cold plate in a continuous manner to lower the temperature of the beer entering the balance lines. If the glycol is chilled to, for example, 28° or 29° F. where it enters the cold plate it can be expected that the beer flowing through the cold plate will be chilled to about 29° F. In such case, the beer as it leaves the cold plate will be conducted to the dispensing valve via the balance lines and will be dispensed at about 35° F. At this temperature, the generation of foam can be minimal if attention and care is applied when the delivery is carried out through the dispensing valve and profits can be preserved.

A system such as that described above is disclosed in U.S. Pat. No. 5,694,787, entitled "Counter Top Beer Chilling Dispensing Tower," issued Dec. 9, 1997 and which the present inventor was a co-inventor. The '787 patent described a glycol recirculating coil unit or basket including elongate tubular glycol inlet and outlet tube sections having upstream ends connected to an upstream manifold and downstream ends connected to a downstream manifold. Between the upstream and downstream manifolds, the stock stainless steel 5/16" ID tubing is arranged in a serpentine manner with alternating runner portions and recurvate end portions forming the glycol recirculating line. The manifold can divide the flow of the glycol at the upstream side into several smaller lines to increase the surface area and decrease the residency time of the cooling fluid, thereby enhancing the heat exchange properties of the glycol unit. The upstream and downstream manifolds connect to feed and return lines for a glycol chiller apparatus that chill the glycol. The entire teachings and disclosure of the '787 patent are fully incorporated herein by reference. A method of making a cold plate is disclosed in U.S. Pat. No. 5,484,015 to Kyees, entitled "Cold Plate and Method of Making Same," the disclosure of which is also incorporated fully herein by reference.

The prior art has relied upon a glycol distribution system within the cold plate that has a multi-outlet manifold. It has been discovered the multi-outlet manifold of the glycol heat exchanging unit may not equally distribute the flow of the heat exchange fluid amongst the divided flow streams. For example, where the manifold has a single large inlet centrally disposed and five exiting lines arranged linearly across the manifold as shown, for example, in FIG. 4 of the '787 patent, then it has been discovered that the exiting lines proximal to the manifold inlet receive a higher proportion of the available glycol and the distal or edge exit lines receive a lower percentage of the glycol. This may be a result of the dynamic pressure present at the central outlets as the inlet flow impinges the outlet, that is not present at the distally located outlets. Because the interleaved lines of beer are substantially of the same temperature and flow rate, a disparity in the chilling effectiveness of the glycol lines will result in a disparate chilling effect across the cross section of the chiller. As a result, a beer line occupying a distally disposed position on the upstream manifold may receive less cooling and be delivered at a higher temperature than those beers occupying a more central position on the manifold. This phenomenon leads to inconsistent results and can overchill some beer lines while underchilling others.

SUMMARY OF THE INVENTION

The present invention is directed to a cold plate for a beer chilling apparatus employing a multi-stage, inlet and outlet glycol flow separation into a plurality of discrete cooling lines using splitter valves that equalize flow distribution between two equally spaced inlet and outlet lines. In a first stage, the upstream inlet of the glycol supply having a first inner diameter is divided into two discrete intermediate segments by a dual inlet connector fitting, where the intermediate segments have a reduced inner diameter with respect to the upstream inlet. The first and second intermediate segments are then each subdivided at a second stage by a pair of dual inlet splitter valves leading to four discrete cooling lines, where the inner diameter of the second stage cooling lines are reduced in comparison with the intermediate segments. Alternatively, the second stage can be further divided in a third stage of eight cooling lines of a diameter smaller than the four adjacent intermediate segments. At the opposite side of the cold plate the multiple cooling lines are reduced down to a single coolant outline line by means of an equal number of splitter values mounted in reverse whereby each splitter valve reduces two coolant lines to one line. The number of ultimate cooling lines N can be characterized as $N=2^S$, where S is the number of stages and S is greater or equal to 2. By using dual outlet splitter valves with orifices equidistance from the fluid inlet in each stage of the glycol distribution piping, there is no resultant pressure imbalances due to the dynamic pressure of the inlet flow and the distribution of the glycol flow throughout the set of cooling lines is maintained constant, resulting in a more consistent and efficient beer chilling apparatus.

DETAILED DESCRIPTION OF THE PREFERRED EMBODIMENTS

A rectangular cold plate is formed when molten aluminum is cast formed over a coil basket of beverage conducting lines and coolant conducting lines arranged in a heat exchanging relationship. The embodiments described herein shall refer to the beverage being chilled as beer and the coolant as glycol. However, those skilled in the art will understand that other beverages and coolants can be used. Elongate tubular members formed of stainless steel are formed with inlet and outlet portions, and a serpentine intermediate portion constructed and arranged for intimate heat exchange between fluids flowing through the tubular members of different temperatures. The coil basket comprises both beer conducting lines and glycol conducting lines arranged in a compact, tightly held formation typically secured with metal tie bars, such as heavy wire or the like. The coil basket is placed in a rectangular mold, with the inlets and outlets of the various lines disposed outside the mold. Molten aluminum is then poured into the mold and allowed to cool to cast a metal jacket about the various fluid lines and preserve the heat conducting and absorbing relationship between the two types of fluid lines.

Figure 3:
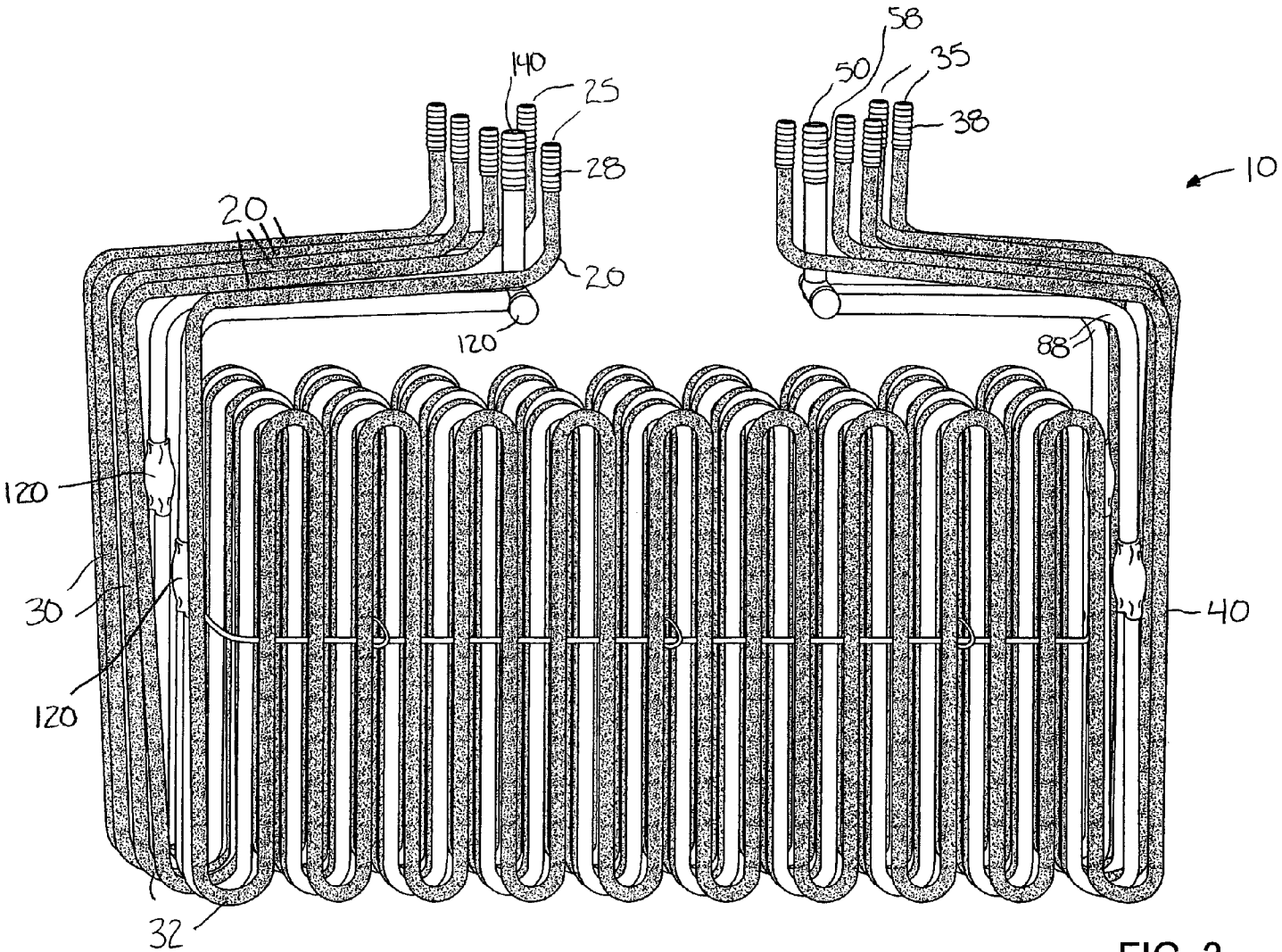
FIG. 3 is a perspective view of a coil basket illustrating the coolant distribution system of FIG. 1 incorporated into series of beverage lines for conducting heat exchange.

The basket 10 of the present invention is shown in FIG. 3 and includes a plurality of beer conducting lines 20 arranged in a group and including a common serpentine pattern. Each beer conducting tube is preferably connected to a trunk line (not shown) at inlets 25 carrying a different variety of beer. The beer lines 20 have an inlet 25 including a barbed end portion 28 adapted to receive a flexible tubing communicating beer from the trunk line. The inlet 25 of the beer conducting lines transitions after jogging outward to a straight length portion 30 spanning substantially the length of the metal jacket. At the end of the straight length portion 30 the tubing forms a U-shaped portion 32 that begins a series of repeating straight sections and curved sections winding across the metal jacket of the cold plate in a compact arrangement. The last leg of this serpentine configuration is a straight portion 40 that symmetrically (with the inlet side) transitions to an outlet 35 having a barbed portion 38 for receiving a balance line (not shown) leading to the dispensing valve. Adjacent beer lines 20 conform with this pattern to form a closely held grouping stacked to minimize the space taken up by the fluid lines.

The basket 10 also includes the glycol circulation lines dispersed between the beer conducting lines 20 and held in intimate contact for proper heat exchange. The glycol circulation system shown in isolation in FIGS. 1 and 2 includes an inlet 50 disposed adjacent the outlets 35 of the beer conducting lines 20 and formed with a barbed portion 58 to retain a glycol feed line (not shown) that connects to the cold plate. The inlet 50 further includes a straight pipe portion 60 leading to a cylindrical compartment 65 with a longitudinal axis traverse with the longitudinal axis of the straight pipe portion 60. The cylindrical compartment 65 has an inlet 70 at a centered position on its top surface where the straight pipe portion 60 is welded, such that glycol conducted through the straight pipe portion 60 enters and fills the cylindrical compartment 65. The cylindrical compartment 65 includes two outlets 75 on the bottom surface equally spaced from the central inlet location, and each outlet 75 is welded to an intermediate inlet tubing element 80 such that each intermediate inlet tubing element 80 receives an equal distribution of the glycol flow entering the cylindrical compartment 65. Here, the internal diameter of each intermediate segment 80 is smaller compared with the inner diameter of the straight pipe section 65, and the pair of intermediate segments 80 are preferably arranged in a parallel orientation having conforming curvatures forming an elbow section 88. The transition from a single flow through the straight pipe 60 of the inlet 50 to the pair of intermediate segments 80 constitutes a first stage.

Figure 1:
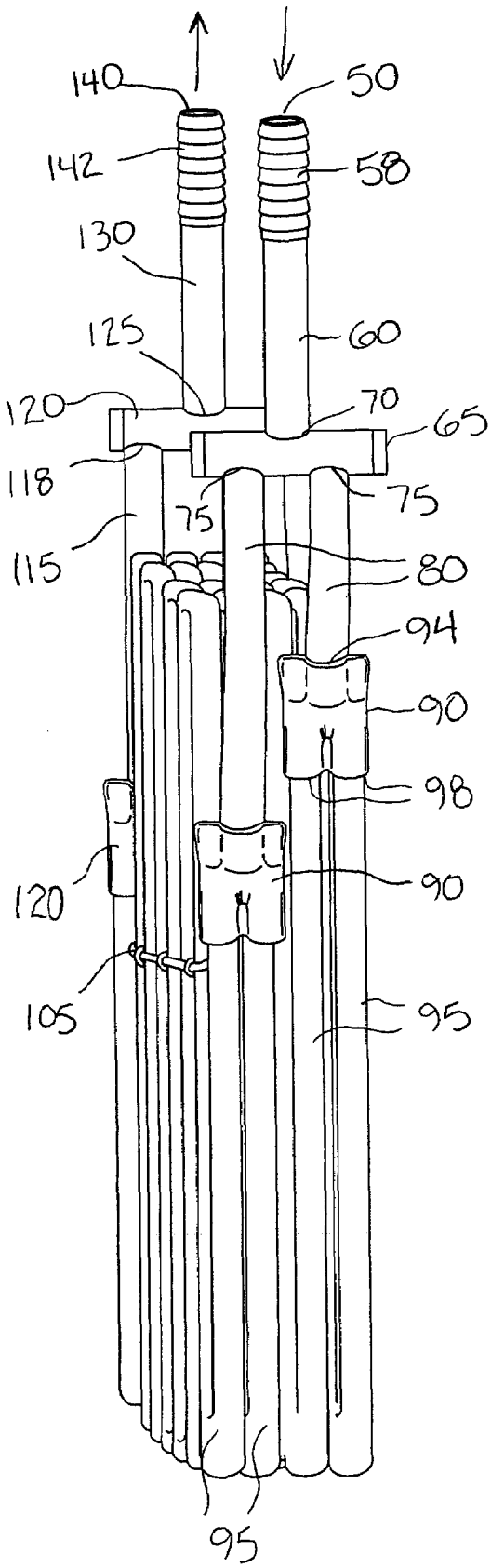
FIG. 1 is a perspective view, predominantly from the side, of a coolant distribution piping system embodying the present invention.

The two intermediate segments 80 at the end of the elbow 88 each terminate in a Y-connector or splitter clip 90 that further divides the flow in each intermediate segment 80 into two smaller, heat exchanging tubes 95. Again, the outlets 98 of the Y-connector 90 are spaced equal distant from the inlet 94 so as to equalize the flow between the two heat exchange tubes 95. It may be necessary to stagger the location of the Y-connectors 90 in the vertical direction as shown in FIG. 1 in order to minimize the profile of the basket 10, since the Y-connectors 90 have a width greater than the width of two heat conducting tubes 95. Placing the two Y-connectors 90 at the same vertical location could unnecessarily widen the basket 10 at that point, so slightly staggering the position of the Y-connectors provides a more compact configuration. The creation of the four heat exchanging lines 95 from the two intermediate segments 80 comprise the second stage.

Figure 2:
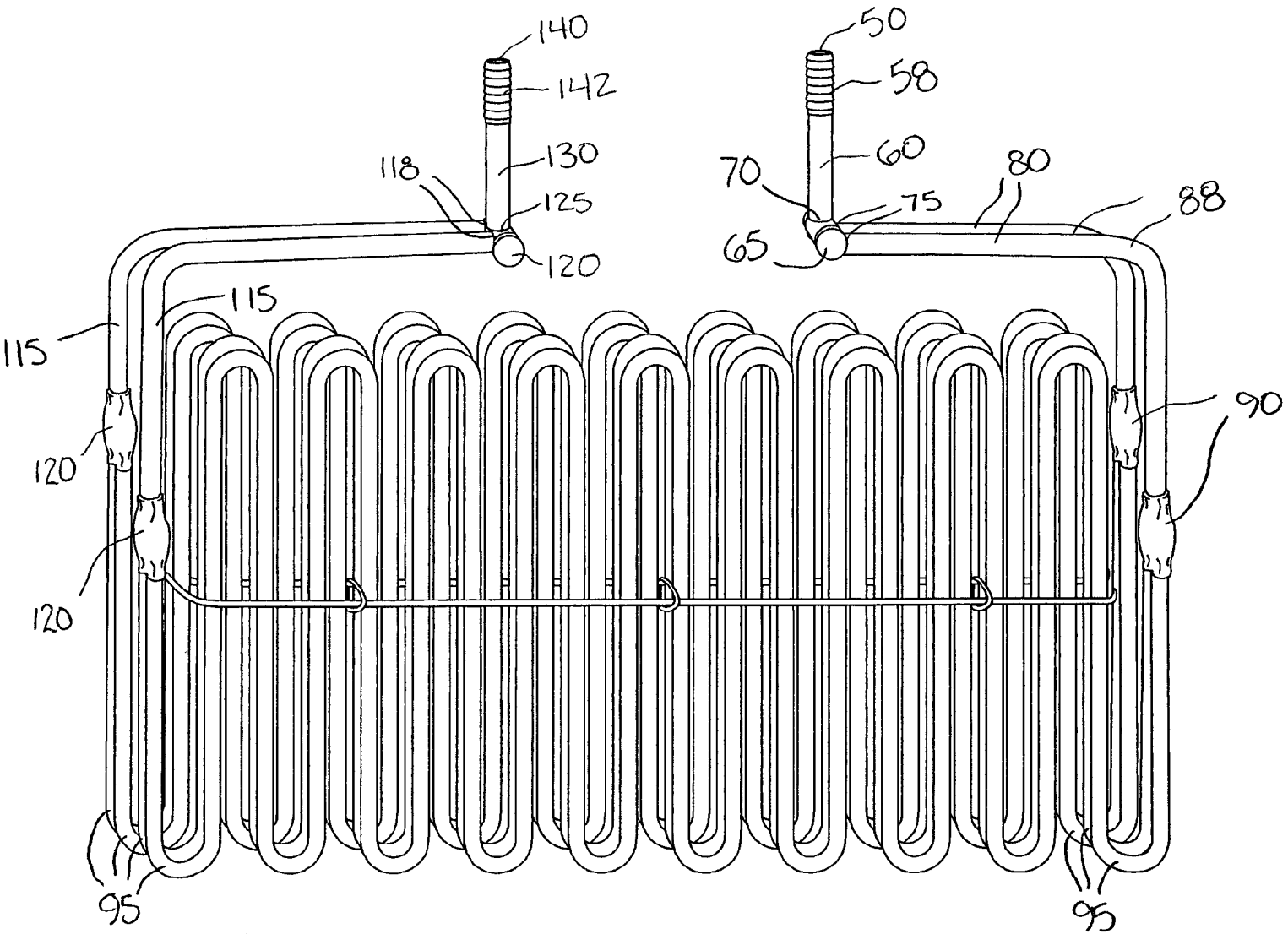
FIG. 2 is perspective view, predominantly from the front, of the coolant distribution piping system of FIG. 1.

The four heat exchanging tubes 95 are preferably arranged substantially in a common plane as shown in FIG. 2, and assimilate into the grouping of the beer conducting tubes 20 of the basket 10. The beer conducting tubes 20 and the heat exchanging tubes 95 alternate and are held together such that preferably each beer line is in contact with two glycol lines throughout the sinuous windings of the two types of lines. The chilled glycol flowing through tubes 95 remove heat from the metal beer lines 20, until the beer exiting the basket 10 at outlets 35 are approximately the temperature of the glycol inlet 50, that is, about 29° F. Because the glycol flow has been reduced in two stages, each stage exactly doubling the lines of the previous stage, the resultant flows are equally balanced and each beer line is subjected to the same heat exchanging conditions.

At various locations along the length of the heat exchange portion of the basket 10, metal ties 105 are used to secure the relationship of the beer lines 20 and glycol lines 95. Metal ties 105 also help to prevent the stainless steel lines from separating or deforming significantly when the thermal shock resulting from the molten aluminum (at 1400° F.) fills the mold by binding the tubes in their stacked configuration.

The four heat exchanging tubes 95 conducting the glycol, after extending through the serpentine course formed with the bundle of beer conducting tubes 20, converges into two intermediate outlet segments 115 in the same manner as that described for the inlet stage two. That is, two Y-connectors 120 each consolidate two heat exchanging tubes 95 into an intermediate segment 115 having an inner diameter larger than the inner diameter of the heat exchanger tubes 95. The two intermediate outlet segments 115 feed to a cylindrical compartment 120 along a bottom surface thereof, where the inlets 118 to the cylindrical compartment 120 are equally spaced from a centrally disposed outlet 125. The outlet 125 feeds a single straight pipe section 130 leading to glycol outlet 140 with barbed end portion 142 that carries the end of a glycol return line for carrying away the heated glycol back to the glycol chilling station.

In describing the above glycol circulating system, the term Y-connector or splitter should be interpreted broadly as any fluid dividing member that has either one inlet line and two outlet lines, or two inlet lines and one outlet. Thus, the cylindrical compartments described with respect to the first stage division and consolidation should be considered Y-connectors for purposes of this application. Likewise, clips or other flow dividers that provide a 2 for 1 flow division or flow consolidation are also properly considered Y-connectors.

Each stage of the glycol flow subdivision is preferably accompanied by a reduction in the inner diameter of the downstream tubing, but in a preferred embodiment the cross-sectional area of the two downstream tubing is greater than the cross sectional area of the upstream tubing. This increase in the flow capacity of the downstream tubing results in a slowing of the fluid flow through the heat exchange portion of the basket 10 leading to more efficient heat exchange conditions. That is, the resident time for the glycol in the heat exchanger is increased and thus the efficiency of the heat exchange in improved when compared to faster moving glycol flow.

While the description above discloses two stages of glycol subdivision forming four discrete heat exchanging tubes 95, the present invention can be expanded to a third stage of subdivision wherein the four heat exchanging tubes are replaced with four transitional tubes that each incorporate a Y-connector at a staggered position with respect to each other to yield eight individual heat conducting tubes in a manner similar to that described above. Employing eight heat exchanging lines increases the available contact area with the beer conducting lines and can further slow the flow of glycol in the manner described above. However, machining smaller tubes can be more expensive and increase the overall cost of the cold plate. Further, because the walls of the tubing are minimized in the heat exchanging portion of the basket to facilitate heat transfer, smaller tubes may be susceptible to crimping which can block flow and negatively impact heat transfer. Those skilled in the art will recognize that additional stages of subdivision can be provided to allow for additional heat exchanging lines if desired.

Figure 4:
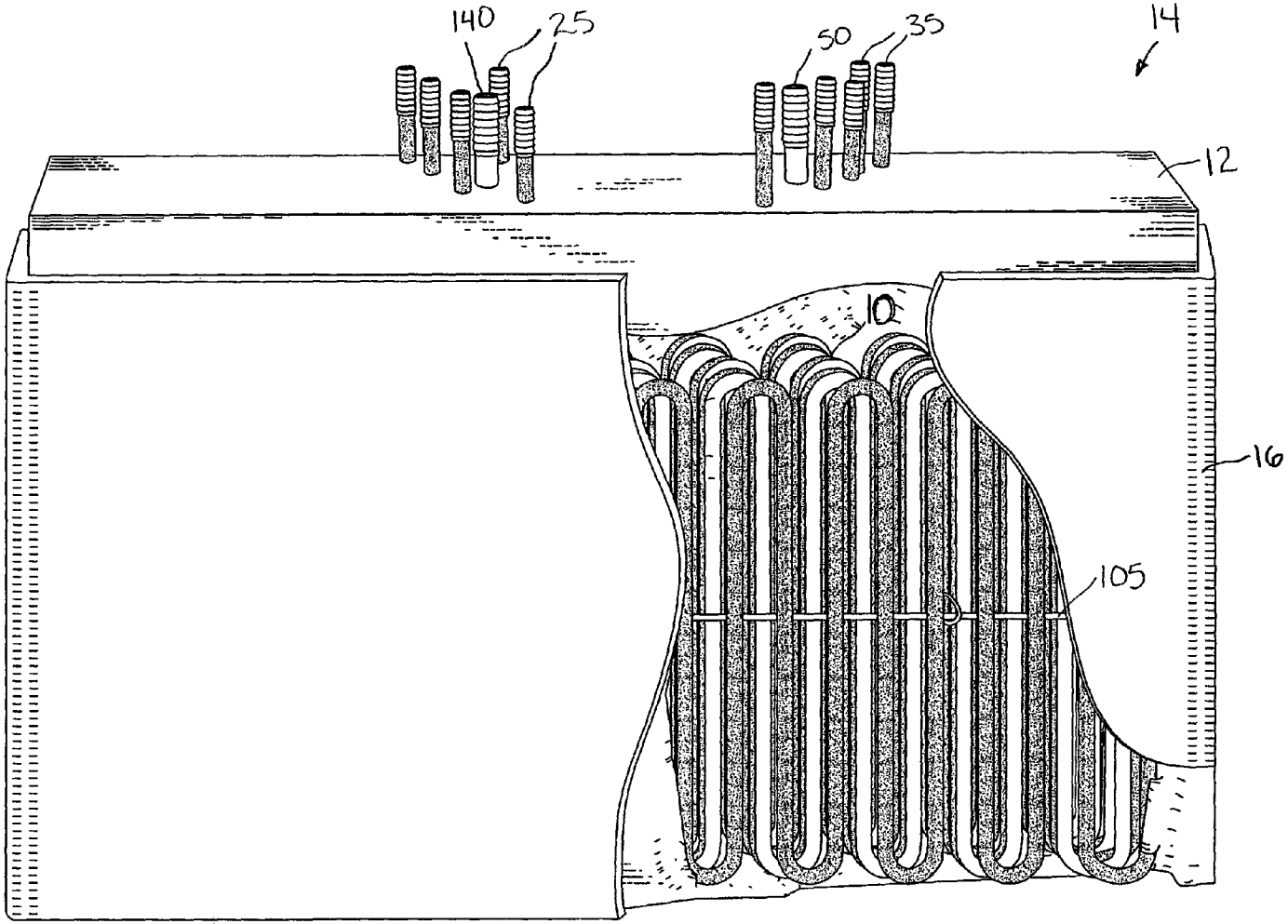
FIG. 4 is a perspective view of a cold plate, partially in cut-away, incorporating the coil basket of FIG. 3.

Referring to FIG. 4, the basket 10 is placed in a mold having a rectangular cavity for forming the aluminum jacket 12. The mold is of sufficient depth to allow the basket 10 to be centered within the cold plate 14 and provides adequate clearance to account for the increased thickness at the Y-connectors. The mold is oriented so that the inlet 50 and outlet 140 of the glycol circulating system and the beer conducting inlets 25 and outlets 35 are exposed out of the bottom of the mold. With the mold closed, the molten aluminum is poured into the mold until the mold is filled, and the thusly formed jacket 12 is allowed to cool and harden to form a thermally conductive housing for the heat exchanging components. The molten aluminum also brazes together the tubings and metal ties in a fixed structure. The thermally conducting jacket 12 can then be encased in insulating material 16 to prevent heating of the glycol by the ambient temperature.

In the above described cold plate 14, each glycol conducting heat exchanging tubing 95 carries the same glycol flow and, where contact with the accompanying beer lines are maintained in a consistent manner, cooling of the beer lines 20 will likewise be consistent. Temperature differences and over/under chilling of the respective beer lines are avoided by use of the multi-stage dual outlet distribution of the glycol flow as described.

Although the foregoing embodiments have been described in terms of a beer cooling system utilizing glycol as the coolant, it is to be understood that the invention is not limited to the beverage being beer and the coolant being glycol. Other beverages may be chilled by the present invention and other coolants or refrigerants known to those skilled in the art can be used.

Similarly, although the serpentine basket shown in FIGS. 1 and 2 is described herein as carrying the coolant (glycol) it is to be understood that the basket shown in said figures can also be used to convey the drinking beverage through the cold plate.

What is claimed is:

1. A cold plate for a beverage chilling apparatus comprising:

a plurality of beverage conducting tubes each having an inlet end, an outlet end, and an intermediate portion constituting a sinuous pattern between said inlet end and said outlet end;

a coolant heat exchanging unit comprising an inlet having a first inner diameter, a first Y-coupling connected to the inlet at a first stage, first and second upstream intermediate segments in fluid communication with first Y-coupling, said first and second upstream intermediate segments having an inner diameter less than the inlet inner diameter, a second Y-coupling connected to the first upstream intermediate segment at a second stage and a third Y-coupling connected to the second upstream intermediate segment at the second stage, four heat exchanging lines connected to respective outlets of the second and third Y-couplings and each heat exchanging line having an inner diameter less than the inner diameter of the first and second upstream intermediate segments, the four heat exchanging lines arranged in a heat exchanging relationship with the beverage conducting tubes at their respective intermediate portions, fourth and fifth Y-couplings connecting the four heat exchanging lines with first and second downstream intermediate segments, and a sixth Y-coupling connecting the first and second downstream intermediate segments with an outlet;

a metal jacket encasing the beverage conducting tubes and the coolant heat exchanging unit between their respective inlets and outlets.

2. The cold plate of claim 1 further comprising a plurality of metal tie bars coupling the beverage conducting tubes and heat exchanging lines in a heat exchanging relationship.

3. The cold plate of claim 1 wherein the heat exchanging lines are each arranged in a repeating sinusoidal path.

4. The cold plate of claim 3 wherein each heat exchanging line conforms with an adjacent heat exchanging line in a stacked configuration.

5. The cold plate of claim 1 wherein the heat exchanging lines are constructed of stainless steel.

6. A cold plate for a beverage chilling apparatus comprising:

a plurality of elongate beverage conducting tubes arranged substantially in a sinuous configuration;

a coolant circulating system disposed in heat exchanging relation with the plurality of elongate beverage conducting tubes and comprising an inlet tubular member, first and second upstream intermediate tubular members in fluid communication with the inlet tubular member and connected to the inlet tubular member by a splitter having only one inlet and only two outlets, the two outlets spaced equal distance from the one inlet, first and second pairs of heat exchanging tubular members in fluid communication with the first and second upstream intermediate tubular members, the first pair of heat exchanging tubular members connected to the first upstream intermediate tubular member by a splitter having only one inlet and only two outlets, the two outlets spaced equal distance from the one inlet, the second pair of heat exchanging tubular members connected to the second upstream intermediate tubular member by a splitter having only one inlet and only two outlets, the two outlets spaced equal distance from the one inlet, first and second downstream intermediate tubular members, said first downstream intermediate tubular member connected to the first pair of heat exchanging tubular members by a consolidating connector having only two inlets and only one outlet, and the second downstream intermediate tubular member connected to the second pair of heat exchanging tubular members by a consolidating connector having only two inlets and only one outlet, and an outlet tubular member connected to the first and second downstream intermediate tubular members by a consolidating connector having only two inlets and only one outlet; and a cast aluminum jacket encasing the plurality of beverage conducting tubes and the coolant circulating system.

7. A beverage cooling apparatus comprising:

a plurality of beverage conducting tubes each having an inlet end, an outlet end, and an intermediate portion comprising an alternating pattern of runners and recurvate members between said inlet end and said outlet end;

a coolant heat exchanging unit comprising an inlet having a first inner diameter, a first Y-coupling connected to the inlet at a first stage, first and second upstream intermediate segments in fluid communication with first Y-coupling, said first and second upstream intermediate segments having an inner diameter less than the inlet inner diameter, a second Y-coupling connected to the first upstream intermediate segment at a second stage and a third Y-coupling connected to the second upstream intermediate segment at the second stage, four heat exchanging lines connected to respective outlets of the second and third Y-couplings and each heat exchanging line having an inner diameter less than the inner diameter of the first and second upstream intermediate segments, the four heat exchanging lines arranged in a heat exchanging relationship with the beverage conducting tubes at their respective intermediate portions, fourth and fifth Y-couplings connecting the four heat exchanging lines with first and second downstream intermediate segments, and a sixth Y-coupling connecting the first and second downstream intermediate segments with an outlet;

a solid metal jacket encasing the beverage conducting tubes and the coolant heat exchanging unit between their respective inlets and outlets.

8. A cold plate for a beverage chilling apparatus comprising:

a plurality of elongate beverage conducting tubes arranged substantially in an alternating pattern of runners and recurvate members; and a coolant circulating system disposed in heat exchanging relation with the plurality of elongate beverage conducting tubes and comprising an inlet tubular member, first and second upstream intermediate tubular members in fluid communication with the inlet tubular member and connected to the inlet tubular member by a splitter having only one inlet and only two outlets, the two outlets spaced equal distance from the one inlet, first and second pairs of heat exchanging tubular members in fluid communication with the first and second upstream intermediate tubular members, the first pair of heat exchanging tubular members connected to the first upstream intermediate tubular member by a splitter having only one inlet and only two outlets, the two outlets spaced equal distance from the one inlet, the second pair of heat exchanging tubular members connected to the second upstream intermediate tubular member by a splitter having only one inlet and only two outlets, the two outlets spaced equal distance from the one inlet, first and second downstream intermediate tubular members, said first downstream intermediate tubular member connected to the first pair of heat exchanging tubular members by a consolidating connector having only two inlets and only one outlet, and the second downstream intermediate tubular member connected to the second pair of heat exchanging tubular members by a consolidating connector having only two inlets and only one outlet, and an outlet tubular member connected to the first and second downstream intermediate tubular members by a consolidating connector having only two inlets and only one outlet.

* * * * *